US010051973B2

(12) United States Patent
Morgan et al.

(10) Patent No.: US 10,051,973 B2
(45) Date of Patent: Aug. 21, 2018

(54) AIR CONDITIONED MATTRESSES

(71) Applicant: Sealy Technology LLC, Trinity, NC (US)

(72) Inventors: Todd M. Morgan, Kernersville, NC (US); Eric Marshall Tevault, Winston Salem, NC (US); David Michael Moret, Winston Salem, NC (US); Evelyn Elizabeth Fenlon, Kernersville, NC (US); Paul Watkins, Pfafftown, NC (US); Jeff Vanderslice, Kernersville, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 13/804,190

(22) Filed: Mar. 14, 2013

(65) Prior Publication Data

US 2014/0033441 A1 Feb. 6, 2014

Related U.S. Application Data

(60) Provisional application No. 61/677,504, filed on Jul. 31, 2012.

(51) Int. Cl.

| | |
|---|---|
| ***A47C 27/14*** | (2006.01) |
| ***A47C 21/04*** | (2006.01) |
| ***A47C 27/08*** | (2006.01) |
| ***A47C 27/15*** | (2006.01) |
| ***A47C 31/00*** | (2006.01) |

(52) U.S. Cl.

CPC ..... *A47C 27/144* (2013.01); *A47C 21/042* (2013.01); *A47C 21/044* (2013.01); *A47C 21/046* (2013.01); *A47C 27/085* (2013.01); *A47C 27/15* (2013.01); *A47C 31/006* (2013.01)

(58) Field of Classification Search

CPC ..... A47C 21/044; A47C 21/048; A47C 21/04; A47C 27/15; A47C 31/006; A47C 21/042; A47C 21/046; A47C 27/085; A47C 27/144

USPC ..... 5/421, 423, 693, 652.1, 652.2, 694, 710, 5/711, 714, 724, 726, 941

See application file for complete search history.

(56) References Cited

U.S. PATENT DOCUMENTS

| | | | | |
|---|---|---|---|---|
| 2,462,984 | A * | 3/1949 | Horace | 5/423 |
| 2,512,559 | A * | 6/1950 | Williams | 5/502 |
| 6,497,720 | B1 | 12/2002 | Augustine et al. | |
| 6,782,574 | B2 * | 8/2004 | Totton et al. | 5/713 |
| 7,290,300 | B1 * | 11/2007 | Khambete | 5/423 |
| 7,469,432 | B2 * | 12/2008 | Chambers | A47C 21/044 5/423 |
| 7,877,827 | B2 | 2/2011 | Marquette et al. | |
| 7,914,611 | B2 * | 3/2011 | Vrzalik et al. | 96/11 |
| 7,996,936 | B2 * | 8/2011 | Marquette et al. | 5/423 |

(Continued)

FOREIGN PATENT DOCUMENTS

WO 2007060371 A2 5/2007

*Primary Examiner* — David E Sosnowski
*Assistant Examiner* — David R Hare
(74) *Attorney, Agent, or Firm* — Middleton Reutlinger

(57) ABSTRACT

Air conditioned mattresses have a core and at least one encasement configured to receive a conditioned flow of air into the encasement and to allow conditioned air to flow out of the encasement to a sleep surface of the mattress. Additional conditioned air conducting layers are provided in combination with the encasement.

8 Claims, 5 Drawing Sheets

(56) References Cited

U.S. PATENT DOCUMENTS

| | | | | |
|---|---|---|---|---|
| 3,065,763 | A1 | 11/2011 | Brykalski et al. | |
| 8,065,763 | B2 * | 11/2011 | Brykalski et al. | 5/423 |
| 8,181,290 | B2 * | 5/2012 | Brykalski et al. | 5/423 |
| 8,222,511 | B2 | 7/2012 | Lofy | |
| 8,256,236 | B2 | 9/2012 | Lofy | |
| 8,332,975 | B2 | 12/2012 | Brykalski et al. | |
| 8,402,579 | B2 | 3/2013 | Marquette et al. | |
| 8,418,286 | B2 | 4/2013 | Brykalski et al. | |
| 8,434,314 | B2 | 5/2013 | Comiskey et al. | |
| 8,438,863 | B2 | 5/2013 | Lofy | |
| RE44,272 | E | 6/2013 | Bell | |
| 8,490,233 | B2 * | 7/2013 | Essers | A47C 27/005 5/724 |
| 9,131,781 | B2 * | 9/2015 | Zaiss | A47C 21/044 |
| 2002/0058975 | A1 * | 5/2002 | Bieberich | 607/104 |
| 2005/0086739 | A1 * | 4/2005 | Wu | A47C 7/744 5/423 |
| 2005/0278863 | A1 * | 12/2005 | Bahash et al. | 5/726 |
| 2008/0148481 | A1 * | 6/2008 | Brykalski et al. | 5/423 |
| 2009/0271923 | A1 * | 11/2009 | Lewis | 5/81.1 R |
| 2010/0011502 | A1 | 1/2010 | Brykalski et al. | |
| 2011/0010850 | A1 * | 1/2011 | Frias | 5/423 |
| 2011/0107514 | A1 * | 5/2011 | Brykalski et al. | 5/421 |
| 2011/0258778 | A1 * | 10/2011 | Brykalski et al. | 5/421 |
| 2011/0289684 | A1 | 12/2011 | Parish et al. | |
| 2011/0296611 | A1 | 12/2011 | Marquette et al. | |
| 2011/0314837 | A1 | 12/2011 | Parish et al. | |
| 2012/0110734 | A1 * | 5/2012 | An | 5/423 |
| 2012/0319439 | A1 | 12/2012 | Lofy | |
| 2013/0086923 | A1 | 4/2013 | Petrovski et al. | |
| 2013/0097777 | A1 | 4/2013 | Marquette et al. | |
| 2013/0146116 | A1 | 6/2013 | Jovovic et al. | |
| 2013/0186448 | A1 | 7/2013 | Ranalli et al. | |

* cited by examiner

AIR CONDITIONED MATTRESSES

RELATED APPLICATIONS

This application is related to U.S. provisional patent application Ser. No. 61/677,504, filed Jul. 31, 2012.

BACKGROUND

Mattresses for sleeping contain a variety of materials in layers, densities and constructions which are not conducive to air flow. Although static vents have been provided in the side walls of mattresses, these provide only minor air flow to the interior of the mattress which does not reach the sleep surface in any appreciable amount. Some materials such as high loft fibers which are closer to the sleep surface do allow some air flow which may pass through the upholstery or quilt, but not in any amount sufficient to affect the temperature at the sleep surface. Thermoelectric devices are well known and have been employed for many different types of heating and cooling applications, including seating and mattresses. A particular challenge in utilizing thermoelectric devices for heating or cooling of a mattress, which has not been met by the prior art, is even air and thermal distribution. The size and thermal output of the thermoelectric devices and corresponding air moving devices (fans) which are economically feasible for such application generally do not provide sufficient thermal energy or air flow rate for acceptable heating or cooling performance. Mattresses with forced air heating, cooling and ventilation systems normally rely on conduction (heating/cooling the materials within the mattress) and convection (air flow around the sleeper). These approaches do not provide conditioned air directly to the sleep surface, i.e. under the sleeper.

DESCRIPTIONS OF THE FIGURES

SUMMARY

Figure 1:
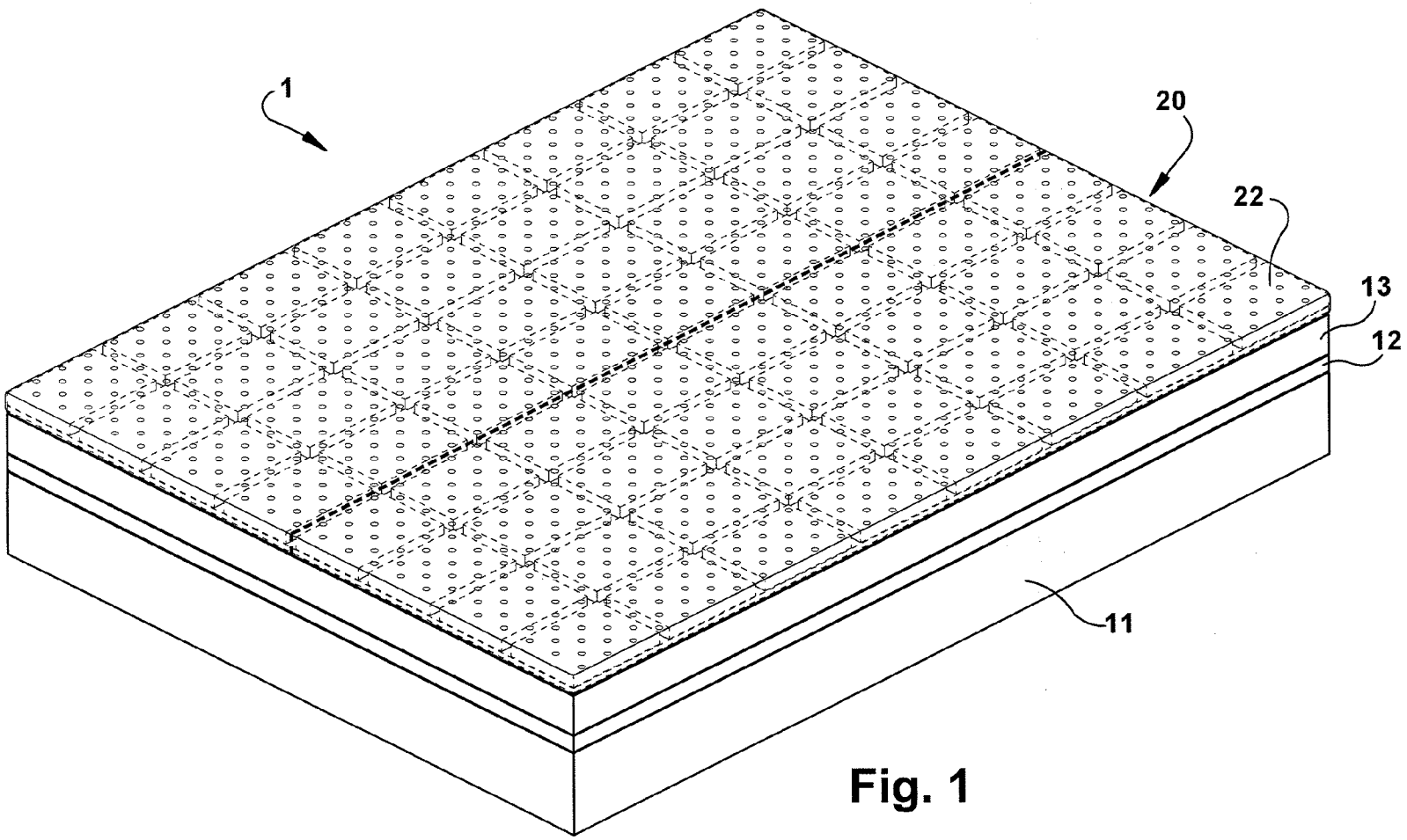
FIG. 1 is a perspective view of an air conditioned mattress of the present disclosure.

The present disclosure and related inventions are of mattresses of a type which provide uniform and controlled flow of heated, cooled or otherwise conditioned air to the sleep surface. In accordance with some of the principals and concepts of the disclosure and related inventions, one or more internal envelopes (also referred to herein as "encasements") are integrated into the construction of the mattress and configured to receive and distribute conditioned air to a top supporting surface of the mattress. An envelope or encasement may be in the form of a generally planar two-sided flexible or fabric enclosure in which is disposed one or more materials or layers of materials which allow the passage of conditioned air generally through levels of supporting materials, an envelope and to the top supporting surface of the mattress. The present disclosure further includes various embodiments of a conductive envelope or encasement which guides conditioned air directly to the sleep surface. Heated or cooled air is delivered to the encasement. Non-air permeable materials in the encasement bottom and sides, and air permeable material on a top side of the encasement directs all of the conditioned air upward directly toward the sleep surface and directly to any body or bodies thereon. Additional layers of material, such as perforated foam can be located over the top side of the encasement. By combining the encasement with high air flow comfort layers such as reticulated foam or non-reticulated and perforated foam, and with a spacer fabric containing tick material, conditioned air is delivered directly to the sleep surface. Cooling and heating effectiveness is greatly enhanced by the conditioned air being forced directly on to the sleeper, as compared to the cooling or heating of mattress materials. Additionally, air flow underneath the body or bodies on the sleep surface reduces the amount of heat energy absorbed by the foam pulling heat away from the body as a heat sink, which increases the cooling effect. The improved thermal performance of the mattresses of the disclosure is achieved by combining convective, conductive and radiant heat to the sleep surface. The various disclosed mattress constructions can also be used with non-thermally conditioned (ambient) air.

DETAILED DESCRIPTION OF PREFERRED AND ALTERNATE EMBODIMENTS

The accompanying drawings, FIGS. 1-5, schematically illustrate representative embodiments of some of the principals and concepts of the disclosure and related inventions. A mattress 1 includes multiple layers such as a base or core layer 11, and one or more intermediate layers such as layers 12 and 13. The core 11 may be made entirely of foam, may include springs or other resilient of reflexive components or also utilize fluid components such as air or water cells or devices or gel. The one or more intermediate layers may similarly be comprised entirely of foam or include or be made of other materials or components. The mattress 1 can be used alone or in combination with a base or foundation or other support structure.

In the representative embodiment, a top surface of the uppermost layer, layer 13, defines a primary structural support surface of the mattress 1, and over which an air distribution layer, generally indicated at 20 is positioned. The layer 20 can be in the form of one or more envelopes or encasements, generally indicated at 22, made of flexible sheet material such as natural or synthetic fabric which is preferably woven and which can contain air up to desired pressures or flow rates within the envelope and provides and means of distributing the air horizontally. As further explained the encasement material or fabric may have selectively located perforations which allow air flow out of the encasement. Within the encasement 22 are one or more materials or constructs which also allow air flow throughout the encasement in various flow patterns. In the embodiment of FIGS. 1-4, the air conditioned layer 20 includes upper and lower sheets 21 which form the encasement 22, a spacer layer 24 within the encasement 22, and a distribution layer 26 within the encasement 22.

The spacer layer 24 is in one embodiment a generally planar structure of interconnected fibers or strands within substantial spacing between the fibers or strands such that air can freely flow through the structure, while the fiber stiffness is sufficient to give the mat or layer rigidity and loft under mechanical load and to support the overlying foam layer 24. A preferred type of spacer layer 24 has continuous fiber strands which have major segments in a generally vertical orientation traveling between opposing planar sides of the layer and adhered to a permeable mesh or woven material layer on each planar side. The foam layer 26 can be as illustrated segmented into multiple segments 261 with channels or otherwise configured air flow passages between the segments for uniform air flow throughout the encasement. The segments 261 may be individual pieces or interconnected such as by a relatively thin layer of foam or other material or adhered or otherwise secured to the spacer layer 24. For example, the channels between the segments 261 can be formed by removing only a portion of the cross-sectional thickness of the foam layer for each channel. Tubing or hollow tape, or spacer material may also be used in the openings or channels between segments 261 for air distribution. In another alternative embodiment, a gel material is disposed in the channels or spaceds between segments 261 to form a gel matrix for thermal transfer and cushioning. Also, the spacer fabric 24 may be slit directionally, in length or width directions to reduce or eliminate bridging across the mattress surface.

In an alternate embodiment the foam layer 26 is perforated and/or formed with passages in the plane of or through the cross-section of the layer 26 to enable air flow throughout the layer in vertical and/or horizontal directions. In another embodiment, reticulated visco-elastic foam or other types of air-permeable foams are placed above and/or below the spacer fabric to allow conditioned air flow through the combined layers. The conditioned air supply may be directed into the spacer fabric for subsequent flow through the foam layer or layers. In another embodiment, air distribution channels are formed in the planar surface of the foam layer adjacent the support surface of the mattress for distribution of conditioned air throughout the support surface of the mattress. In any of these embodiments high-density foam (such as shelf liner type foam with fiber reinforcement) may be used for air distribution by directing a forced air flow laterally into the plane of a high-density foam layer. Any of the described foam layers and foam constructs can be made with foam that includes phase change material (PCM) for storage and release of thermal energy transferred to the foam by forced conditioned air.

Figure 2:
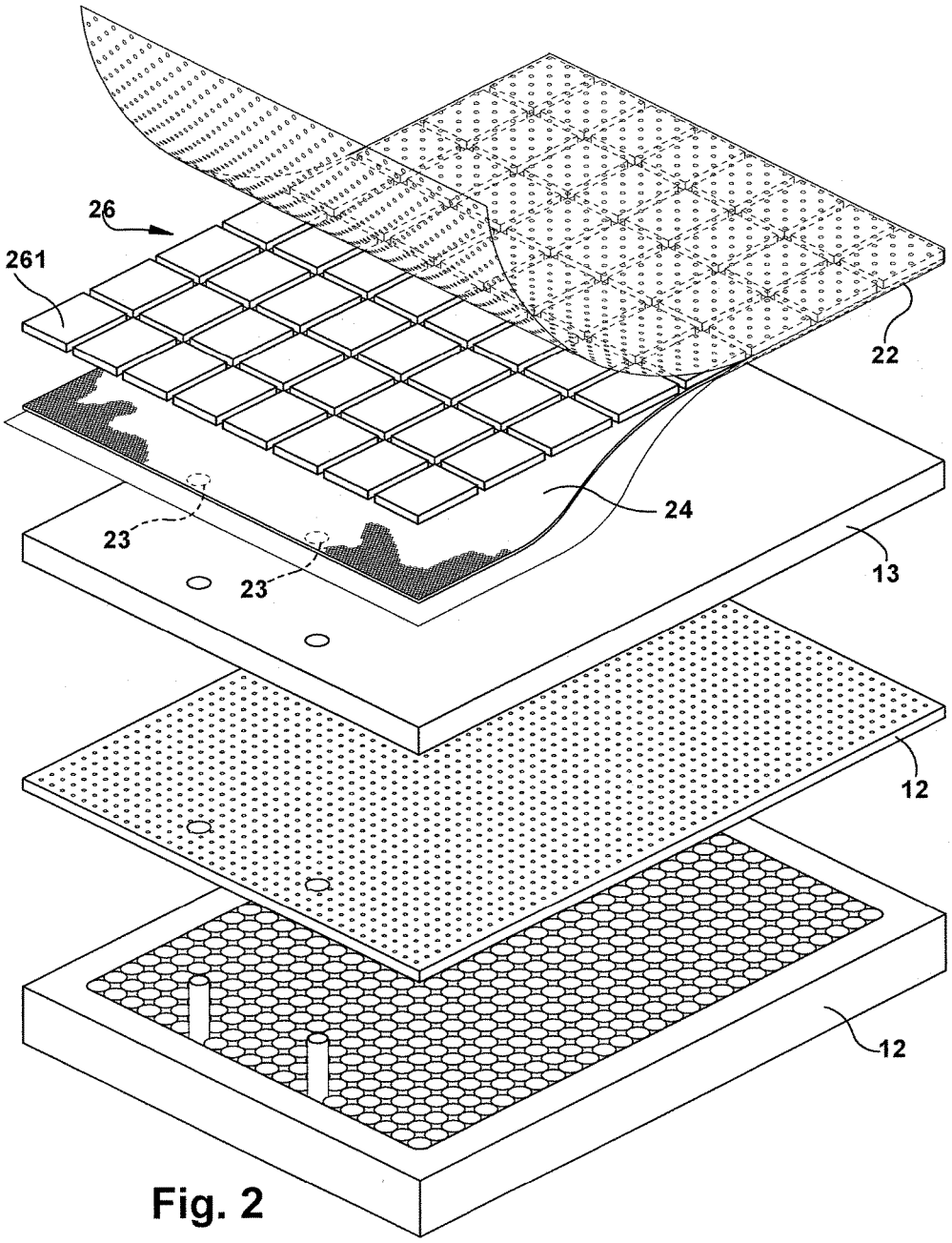
FIG. 2 is an exploded assembly view of primary components of an air conditioned mattress of the present disclosure.
Figure 3:
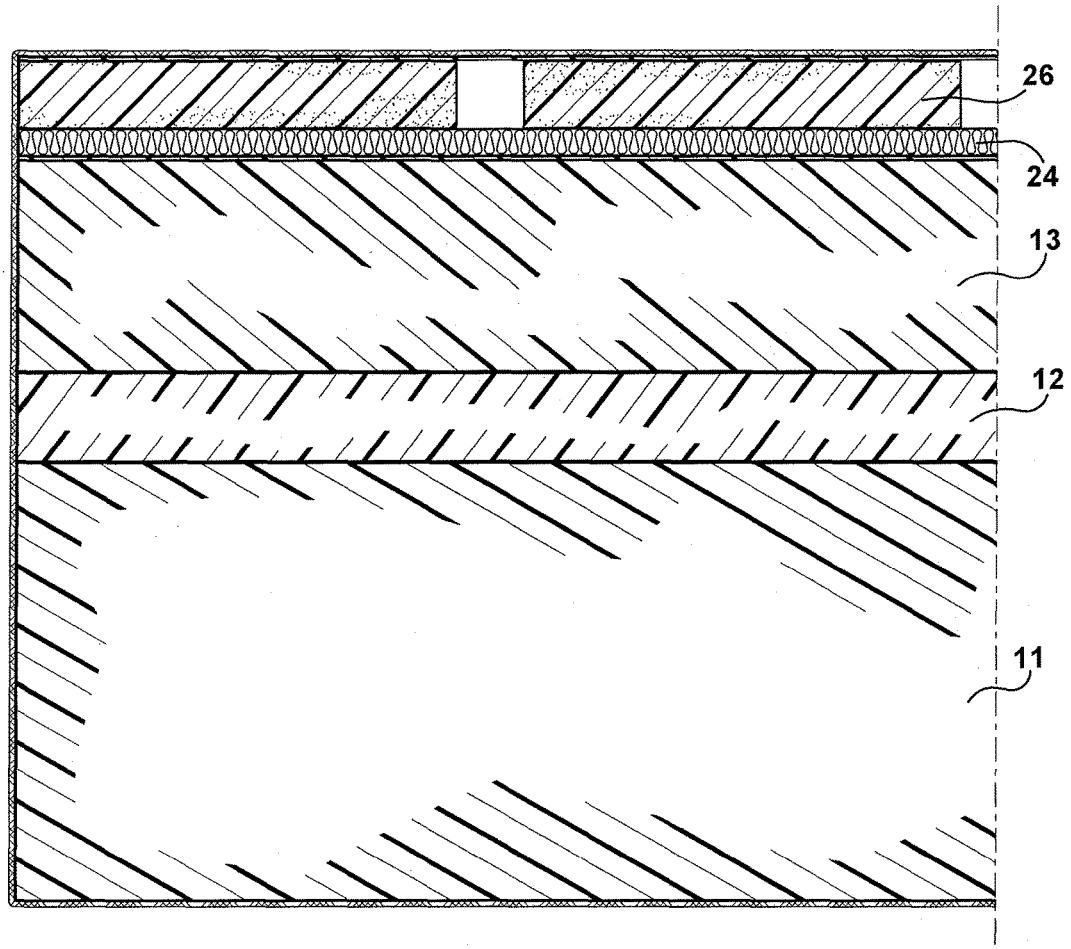
FIG. 3 is a cross-sectional view of a portion of an air conditioned mattress of the present disclosure.
Figure 4:
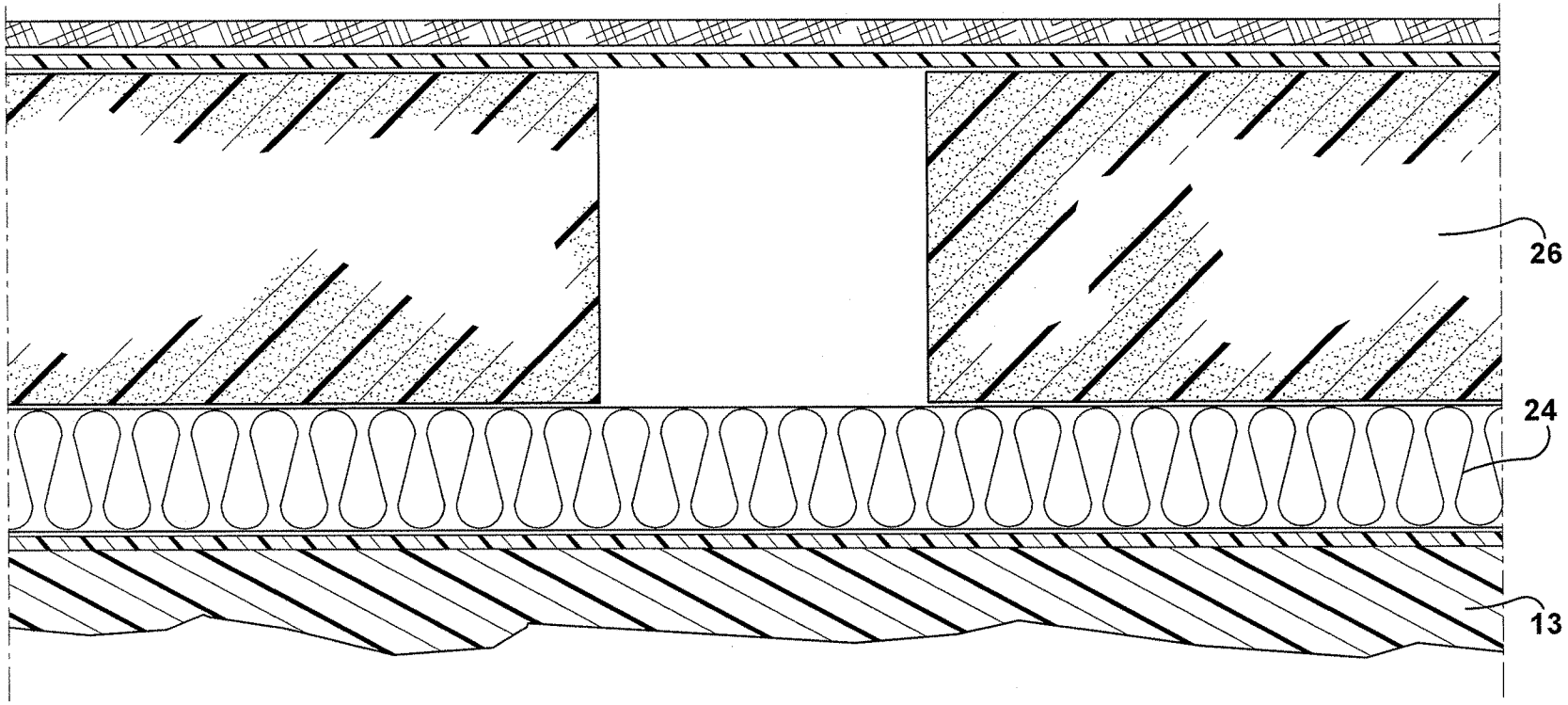
FIG. 4 is a partial cross-sectional view of an air conditioned mattress of the present invention.

Conditioned air, whether heated, cooled and/or moisture controlled, can be supplied to the interior of the encasement 22 via one or more conduits or pathways either directly to the encasement or through other layers of the mattress, such as generally vertically through the mattress layers as shown in FIG. 1, or directly to the encasement 22 such as laterally. As shown in FIG. 2, air supply openings 23 are formed in a bottom layer of the encasement 22 for pressurized flow through the spacer layer 24 and the foam layer 26, and can be aligned with mating air passages in the intermediate and core layers. Perforations in the upper layer of the encasement allow air to flow out of the encasement after passage through the spacer layer 24 and foam layer 26. The perforations in the encasement layer can be aligned with the channels between the foam segments 261. An alternate embodiment is the encasement 220 without top half material allowing free communication of air from spacer 240 into spacer 242.

Figure 5:
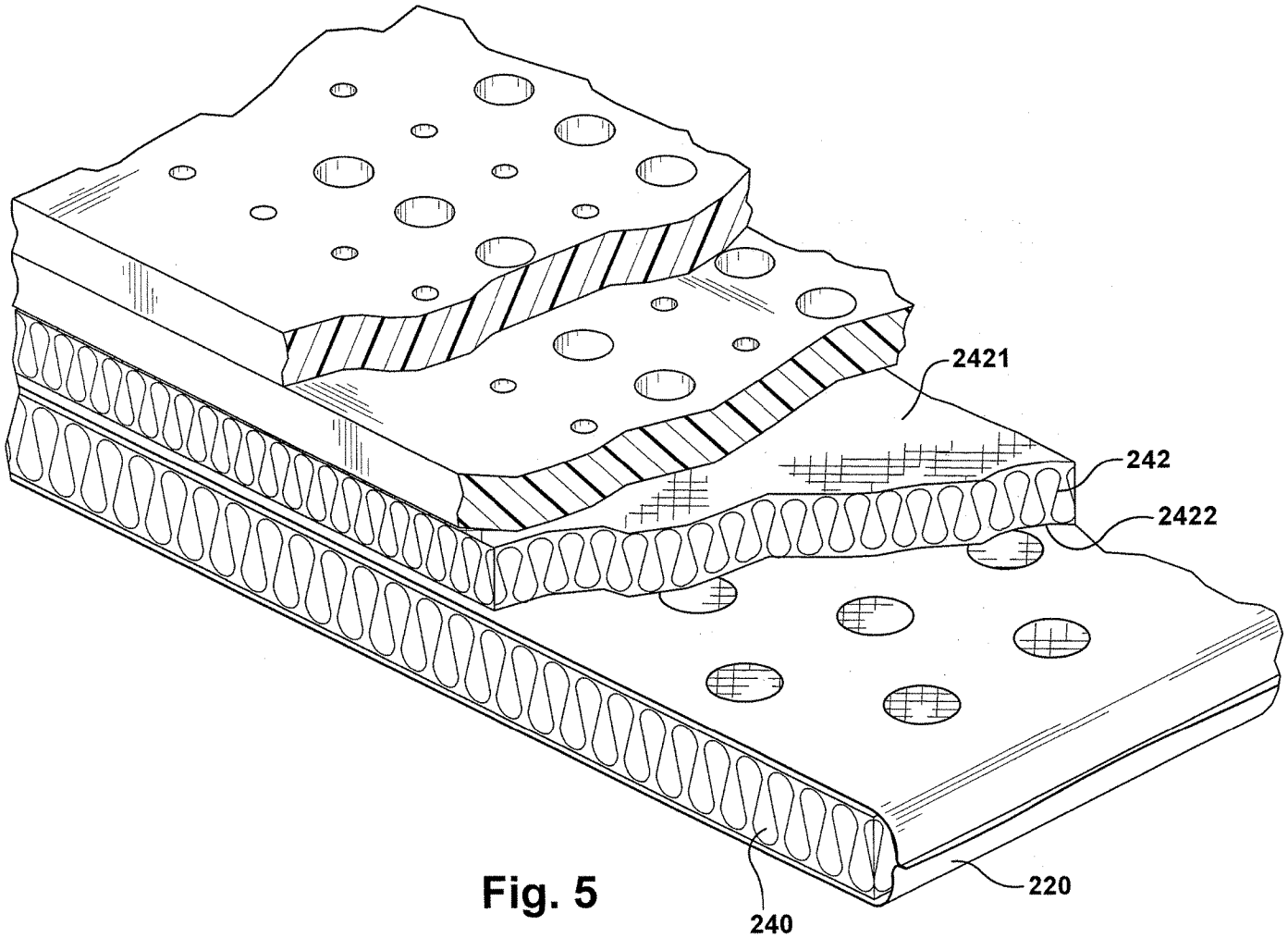
FIG. 5 is a perspective view of portions of layers of an air conditioned mattress of the present disclosure.

FIG. 5 illustrates an alternate embodiment of a spacer layer of the mattress 1, in which a first or primary spacer layer 240 is contained in its own envelope or encasement 220 made of fabric material and having air flow holes 221 therein open to a top side of encasement 220. A secondary spacer layer 242 (which has upper and lower fabric layers 2421, 2422) is positioned over the primary spacer layer 240. The thickness of the secondary spacer layer 242 may be relatively less than that of the primary spacer layer 240. Optionally, one or more foam layers may be placed over the top surface of the secondary spacer layer 240. Alternatively, the top surface of the secondary spacer layer 240 may serve as the primary support surface of the mattress, covered by the mattress upholstery (not shown).

As shown in FIG. 1, the encasement 22 can be divided into parts, such as right and left halves, with a separate or divided air supply to each part. Upholstery of the mattress which overlies the encasement 22, particularly over the planar body support surface, may optionally include phase change material (PCM) which acts as a thermal energy sink or storage and release through change of phase of material as may be encapsulated in micro-particles integrated with or coated on the encasement sheet material.

A forced conditioned air supply to the encasement(s) 22 of the mattress 1 can be from any type of source or equipment, and in an exemplary embodiment includes one or more air transfer devices such as a blower or impeller and one or more thermoelectric devices in the air flow path. Thermoelectric devices (TED) utilize the Peltier effect to create a heat flux between the junction of two different types of materials. A Peltier cooler, heater, or thermoelectric heat pump is a solid-state active heat pump which transfers heat from one side of the device to the other, with consumption of electrical energy, depending on the direction of the current. Such devices are also referred to as thermoelectric coolers (TEC). They can be used either for heating or for cooling by control of current flow to the device. Moisture monitoring and control can also be combined with the air moving and conditioning devices or units. One or more TEDs and associated air blowers or impellers can be either incorporated into the mattress construction, for example internal to the core layer, or located outside of the mattress and fluidly connected to the mattress and ultimately to the encasement 22 via suitable conduits and air passageways. The air conditioning and transfer units are controlled by a control system which functions to control the amount and type of electrical energy to the TEDs for heating or cooling, and the amount and rate of air flow, and timing of these operations. The control system may also include one or more sensors in the mattress for sensing temperature, humidity and air flow rate and volume, which sensor data is sent to the control system for monitoring mattress performance and condition and ongoing control operations. Other types of air conditioning devices for heating, cooling, moisture control and air flow control can be used with the disclosed mattress constructions.

What is claimed is:

1. An air conditioned mattress having:

a core layer; and an air distribution layer positioned over and joined to the core layer, the air distribution layer including a foam layer and at least one spacer layer, the foam layer and the at least one spacer layer completely enclosed by at least one encasement configured to receive a conditioned flow of air into the encasement and to allow conditioned air to flow out of the encasement;

at least one conduit extending through said core layer, into said encasement, for air distribution through said spacer layer and said distribution layer and further air distribution through perforations in said encasement;

wherein said distribution layer comprises a plurality of foam segments, with adjacent foam segments at least partially spaced from one another by a channel and wherein a gel material is disposed in each channel;

wherein the encasement is comprised of a sheet of pliable material having a top side positioned adjacent to the foam layer and a bottom side positioned adjacent to the at least one spacer layer; and, wherein the at least one spacer layer includes a plurality of interconnected fibers configured to allow air to pass therethrough.

2. The air conditioned mattress of claim 1 wherein the at least one spacer layer is comprised of spacer material.

3. The air conditioned mattress of claim 1 wherein the encasement is perforated.

4. The air conditioned mattress of claim 1 wherein the encasement is comprised of an air permeable material on the top side and a non-air permeable material on the bottom side.

5. The air conditioned mattress of claim 1 wherein the foam layer includes perforations.

6. The air conditioned mattress of claim 1, said encasement having selectively located perforations to control at least one of pressures or flow rates of said conditioned air passing therefrom.

7. An air conditioned mattress having:

a core layer; and an air distribution layer positioned over and joined to the core layer, the air distribution layer including a foam layer and at least one spacer layer, the foam layer and the at least one spacer layer completely enclosed by at least one encasement configured to receive a conditioned flow of air into the encasement and to allow conditioned air to flow out of the encasement, at least one conduit near one end of and extending upwardly through said core layer, into said encasement, to distribute air through said spacer layer and to said foam layer and further for air distribution through perforations in said encasement;

wherein said distribution layer comprises a plurality of foam segments spaced from one another by at least one channel and wherein a gel material is disposed in each of said at least one channel;

wherein the encasement is comprised of pliable material, and wherein the at least one spacer layer includes continuous fiber strands with major segments arranged in a generally vertical orientation traveling between opposing planar sides of the spacer layer.

8. An air conditioned mattress having:

a core layer;

an air distribution layer positioned over and joined to the core layer, the air distribution layer including a foam distribution layer and a spacer layer, the spacer layer including a plurality of interconnected fibers to allow air to pass therethrough; and at least one encasement configured to receive and pass conditioned flow, the encasement comprised of a sheet of fabric that completely encloses the foam distribution layer and the spacer layer;

first and second conduits extending upwardly through and near an end of said core layer, into said encasement, to distribute air through said spacer layer and to said distribution layer for distribution through perforations in said encasement;

wherein the foam distribution layer is comprised of a plurality of foam segments, with adjacent foam segments at least partially spaced from one another by a channel; and wherein a gel material is disposed in each channel.

* * * * *